US009027274B2

(12) United States Patent
Pientka

(10) Patent No.: US 9,027,274 B2
(45) Date of Patent: May 12, 2015

(54) FIREARM LEANER

(71) Applicant: MJP Leaning Edge Technologies, LLC, Chandler, AZ (US)

(72) Inventor: Matthew J. Pientka, Chandler, AZ (US)

(73) Assignee: MJP Leaning Edge Technolgies, LLC, Chandler, AZ (US)

( * ) Notice: Subject to any disclaimer, the term of this patent is extended or adjusted under 35 U.S.C. 154(b) by 148 days.

(21) Appl. No.: 13/926,435

(22) Filed: Jun. 25, 2013

(65) Prior Publication Data

US 2014/0007482 A1 Jan. 9, 2014

Related U.S. Application Data

(60) Provisional application No. 61/668,273, filed on Jul. 5, 2012.

(51) Int. Cl.
*F41A 23/18* (2006.01)

(52) U.S. Cl.
CPC ..... *F41A 23/18* (2013.01)

(58) Field of Classification Search
CPC ..... F41A 23/08; F41A 23/10; F41A 23/12; F41A 23/14; F41A 23/16; F41A 23/02; F41A 23/18
USPC ..... 42/94; 89/37.01, 37.04
See application file for complete search history.

(56) References Cited

U.S. PATENT DOCUMENTS

| | | | | |
|---|---|---|---|---|
| 613,241 | A | | 11/1898 | Burton |
| 809,080 | A | | 1/1906 | Wight |
| 897,577 | A | | 9/1908 | Bourne |
| 1,441,285 | A | * | 1/1923 | Johnston et al. ..... 42/94 |
| 2,542,343 | A | * | 2/1951 | Merrill ..... 248/217.4 |
| 2,855,680 | A | * | 10/1958 | Christensen ..... 42/148 |
| 3,225,656 | A | * | 12/1965 | Flaherty et al. ..... 89/37.04 |
| 3,235,997 | A | * | 2/1966 | Stoner ..... 42/94 |
| 3,235,998 | A | * | 2/1966 | Hadley ..... 42/94 |
| 3,302,910 | A | * | 2/1967 | Williams ..... 248/511 |
| 3,876,078 | A | | 4/1975 | Gomes et al. |
| 4,209,157 | A | | 6/1980 | Edmisten |
| 5,333,829 | A | * | 8/1994 | Bell et al. ..... 248/634 |
| D356,137 | S | * | 3/1995 | Hull et al. ..... D22/108 |
| 6,505,429 | B2 | * | 1/2003 | Percival ..... 42/94 |
| D476,290 | S | * | 6/2003 | Gates et al. ..... D12/408 |
| 6,935,065 | B1 | | 8/2005 | Oliver |
| 6,951,072 | B2 | | 10/2005 | Schurtenberger |
| 7,197,844 | B2 | | 4/2007 | Benson |
| D547,643 | S | * | 7/2007 | Ratajczek et al. ..... D8/395 |
| 7,380,486 | B1 | * | 6/2008 | Bean ..... 89/37.04 |
| 2003/0116683 | A1 | * | 6/2003 | Turner et al. ..... 248/65 |
| 2004/0068911 | A1 | * | 4/2004 | Schurtenberger ..... 42/94 |
| 2006/0278797 | A1 | | 12/2006 | Keng et al. |
| 2011/0265367 | A1 | * | 11/2011 | Saunders, III ..... 42/94 |
| 2012/0079753 | A1 | | 4/2012 | Evans-Hendrick |
| 2012/0273631 | A1 | * | 11/2012 | Deros ..... 248/122.1 |
| 2014/0190060 | A1 | * | 7/2014 | Sherman ..... 42/94 |
| 2014/0215888 | A1 | * | 8/2014 | Barber ..... 42/94 |

* cited by examiner

*Primary Examiner* — Bret Hayes
*Assistant Examiner* — Joshua Freeman
(74) *Attorney, Agent, or Firm* — Maier & Maier, PLLC

(57) ABSTRACT

According to at least one exemplary embodiment, a firearm leaner is disclosed. The firearm leaner can include a barrel engaging portion and a pair of arms separated by a gap and extending upwards from the barrel engaging portion. The arms may diverge as they extend outwardly. Each arm can include a plurality of protrusions, which can in turn include a plurality of points. An extension can extend rearwardly from the barrel engaging portion.

14 Claims, 6 Drawing Sheets

FIREARM LEANER

CROSS-REFERENCE TO RELATED APPLICATIONS

This application claims priority to U.S. Provisional Patent Application No. 61/668,273 filed Jul. 5, 2012 and entitled FIREARM LEANER, the entire contents of which are hereby incorporated by reference.

BACKGROUND

When a hunter is in the field, it is often desirable for the hunter to lean his weapon against an object. However, leaning a weapon such as a rifle or shotgun against an object frequently results in the weapon falling to the ground, due to the limited points of contact between the object and the weapon. Such falls can result in accidental discharge, injury, damage to the weapon and scope, as well as noise that can scare away potential targets. A solution for securely supporting weapons on objects is therefore desired.

SUMMARY

According to at least one exemplary embodiment, a firearm leaner is disclosed. The firearm leaner can include a barrel engaging portion and a pair of arms separated by a gap and extending upwards from the barrel engaging portion. The arms may diverge as they extend outwardly. Each arm can include a plurality of protrusions, which can in turn include a plurality of points. An extension can extend rearwardly from the barrel engaging portion.

BRIEF DESCRIPTION OF THE FIGURES

Advantages of embodiments of the present invention will be apparent from the following detailed description of the exemplary embodiments. The following detailed description should be considered in conjunction with the accompanying figures in which.

DETAILED DESCRIPTION

Figure 1:
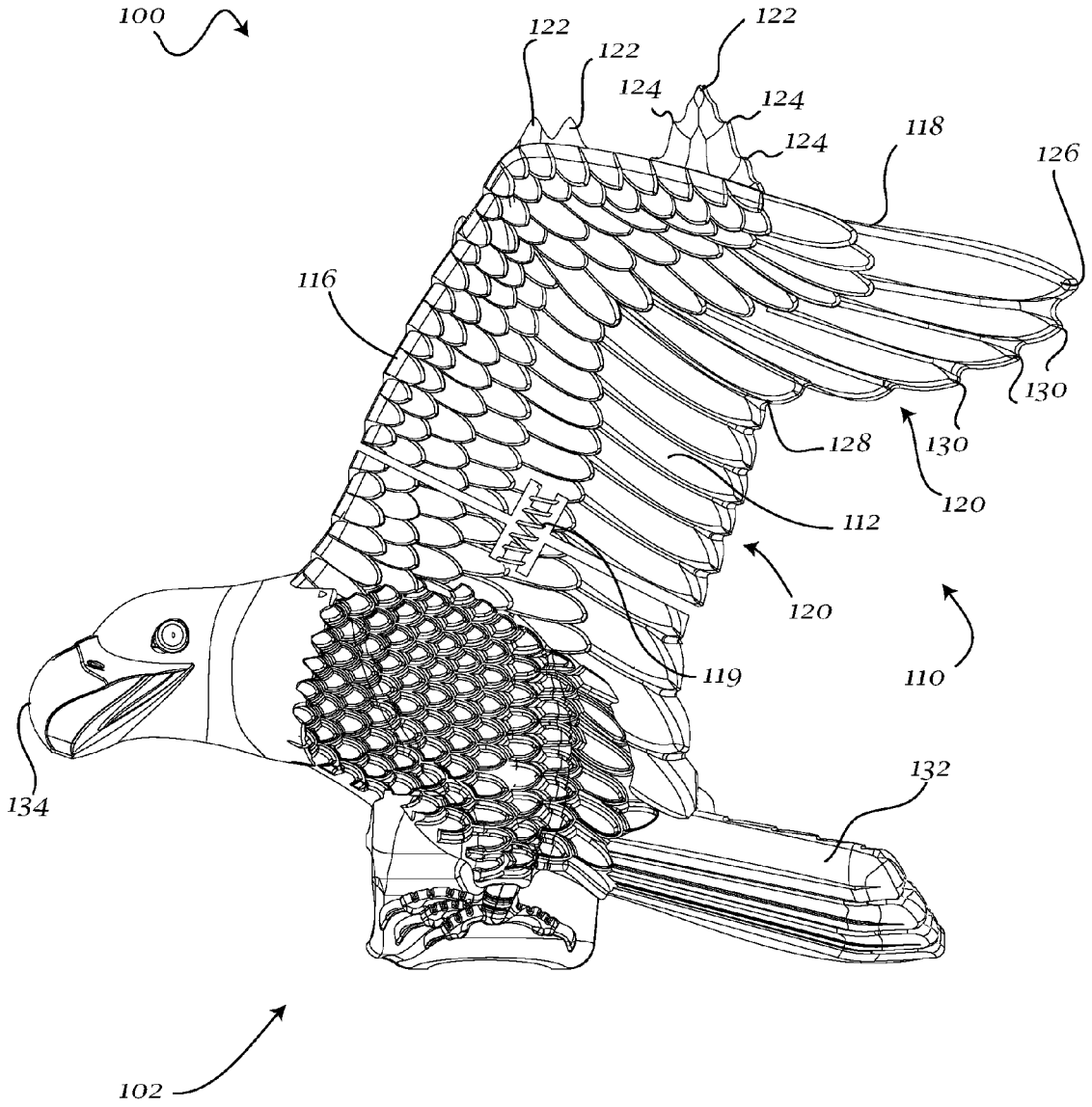
FIG. 1 shows a side view of an exemplary embodiment of a firearm leaner.
Figure 2:
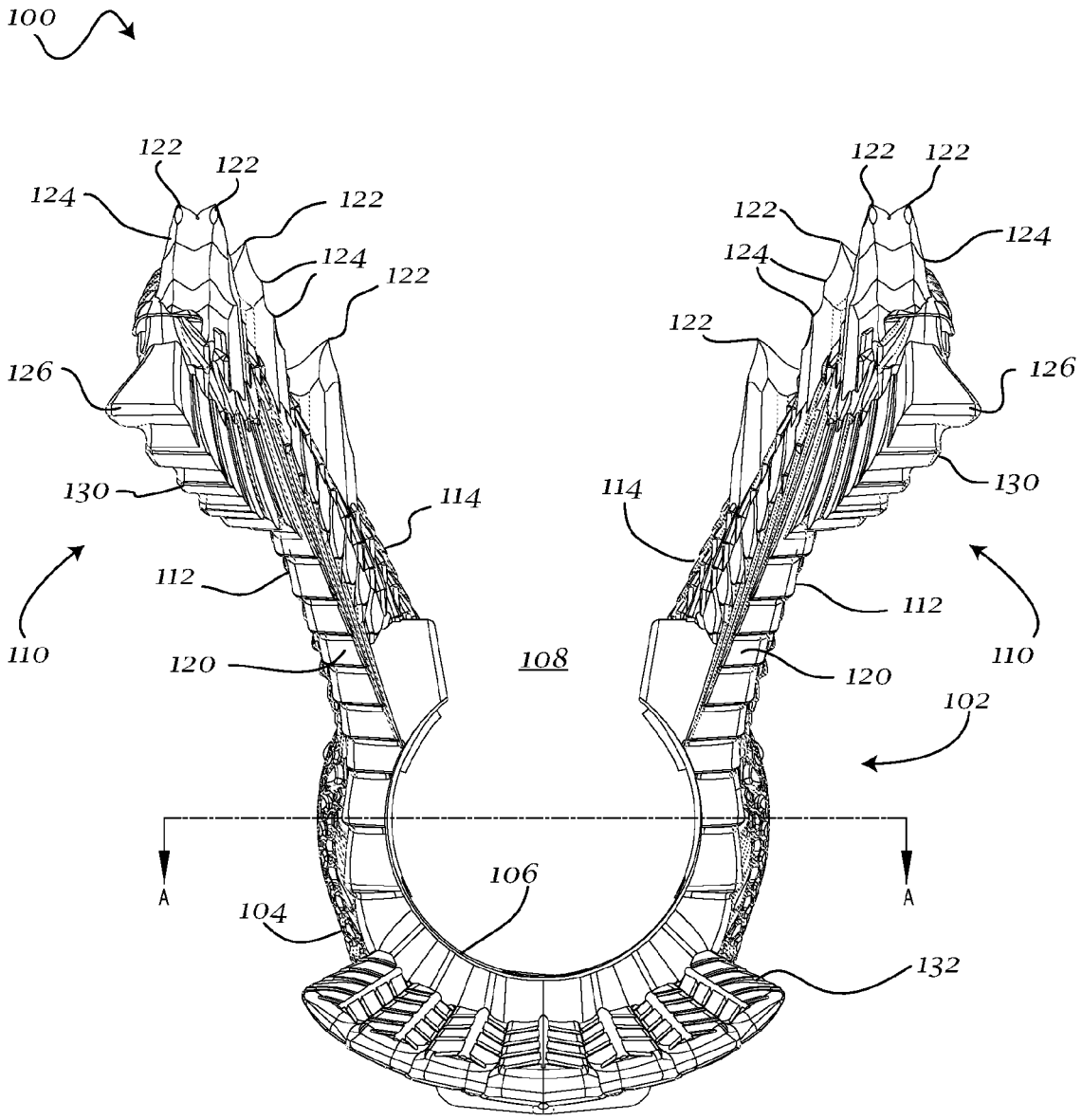
FIG. 2 shows a rear view of an exemplary embodiment of a firearm leaner.
Figure 3:
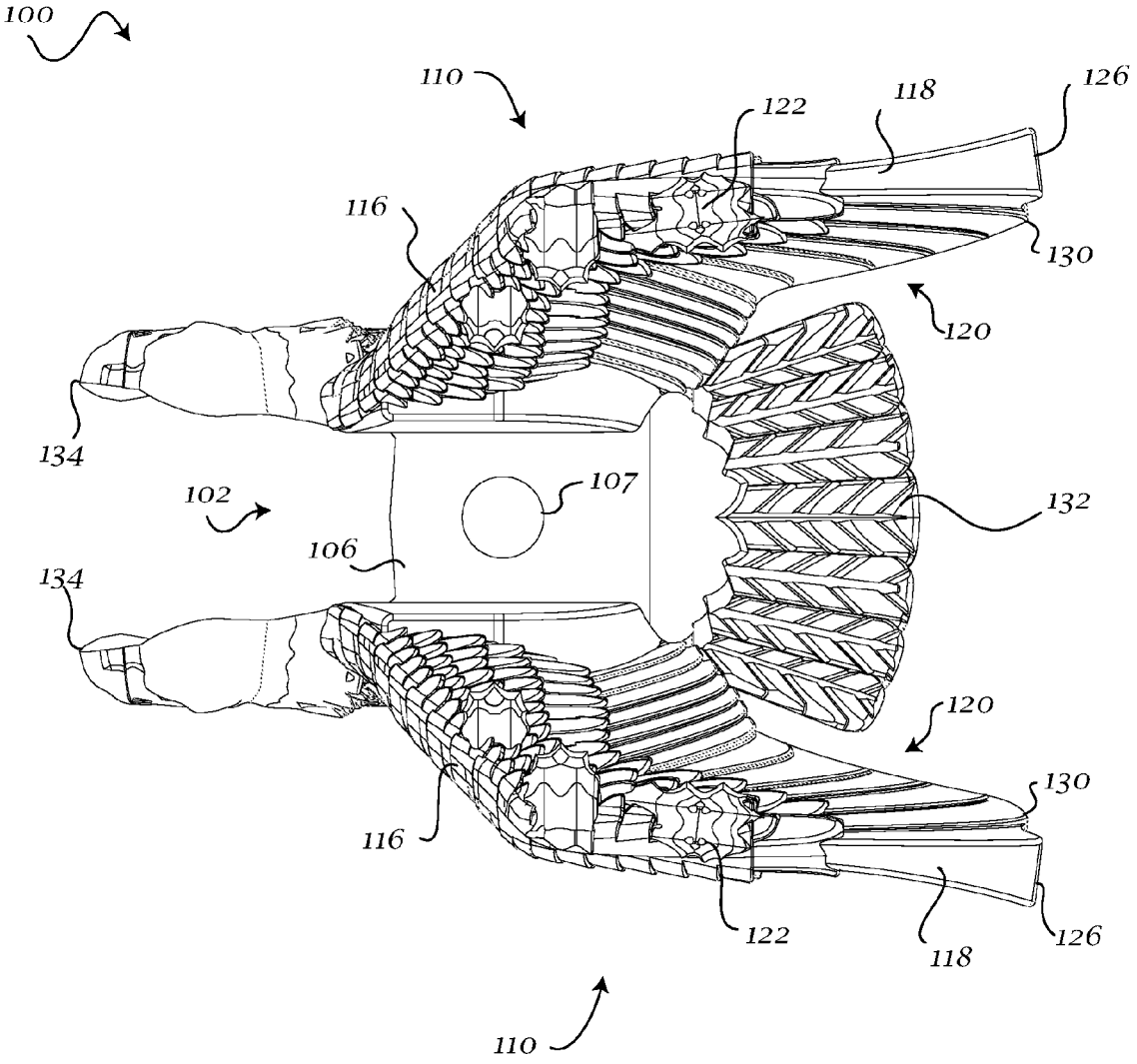
FIG. 3 shows a top view of an exemplary embodiment of a firearm leaner.
Figure 4:
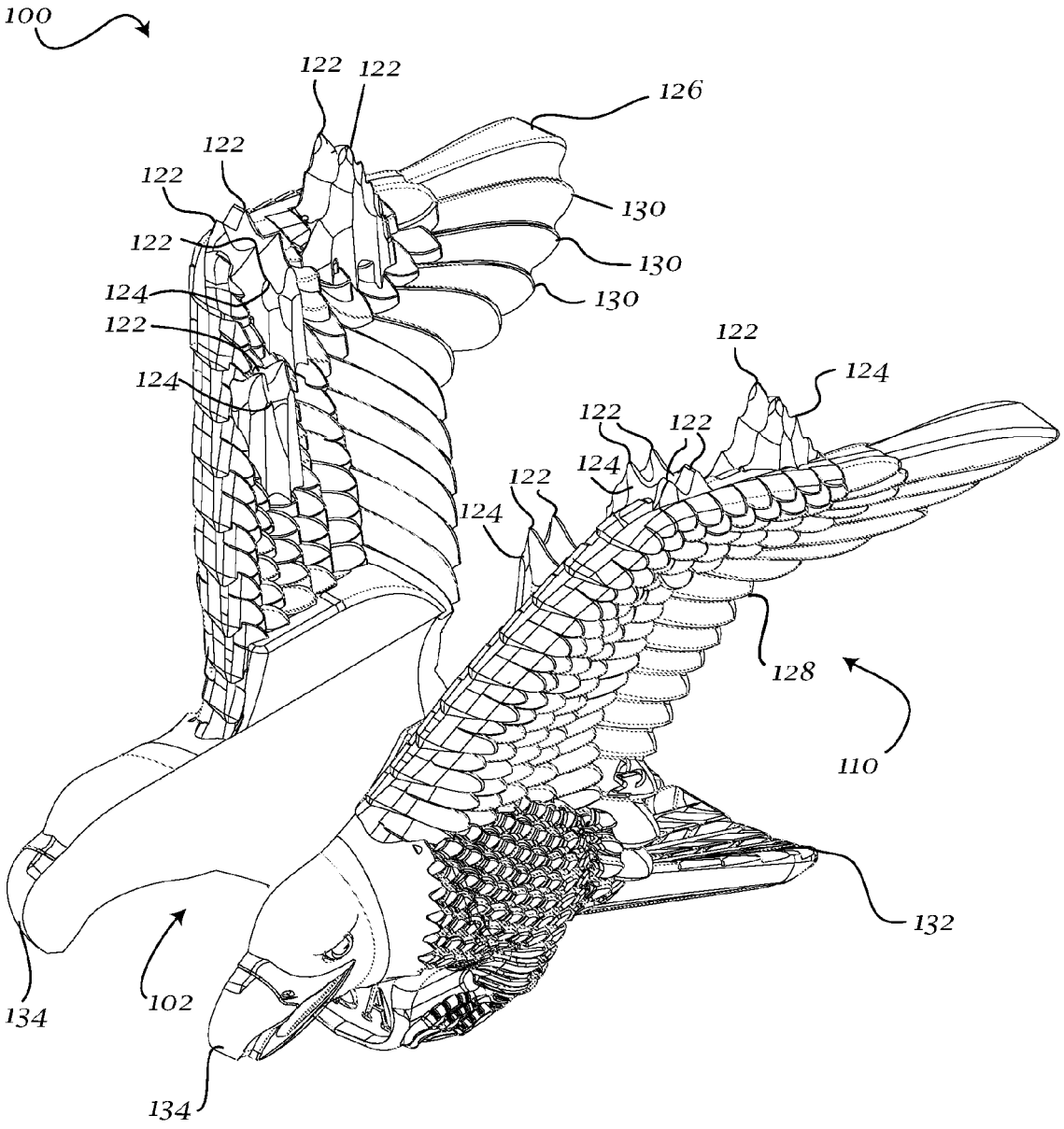
FIG. 4 shows an isometric view of an exemplary embodiment of a firearm leaner.

Aspects of the invention are disclosed in the following description and related drawings directed to specific embodiments of the invention. Alternate embodiments may be devised without departing from the spirit or the scope of the invention. Additionally, well-known elements of exemplary embodiments of the invention will not be described in detail or will be omitted so as not to obscure the relevant details of the invention. Further, to facilitate an understanding of the description discussion of several terms used herein follows.

As used herein, the word "exemplary" means "serving as an example, instance or illustration." The embodiments described herein are not limiting, but rather are exemplary only. It should be understood that the described embodiment are not necessarily to be construed as preferred or advantageous over other embodiments. Moreover, the terms "embodiments of the invention", "embodiments" or "invention" do not require that all embodiments of the invention include the discussed feature, advantage or mode of operation.

According to at least one exemplary embodiment, a firearm leaner may be disclosed. The firearm leaner can include a barrel-engaging portion, and a pair of arms extending upwardly from the barrel engaging portion. Each arm of the pair of arms can include a plurality of points for engaging a surface. The firearm leaner can further include extensions projecting rearwardly from each of the arms and/or from the barrel engaging portion, the extensions adapted to engage an object so as to support the firearm leaner and the firearm to which the firearm leaner is attached.

FIGS. 1-4 show an exemplary embodiment of a firearm leaner 100. Firearm leaner 100 can include a barrel engaging portion 102 having an outer surface 104 and an inner surface 106. Inner surface 106 can be substantially tubular in shape and may be sized to receive a barrel of a firearm. Various embodiments of firearm leaner 100 can be adapted for firearms of diverse sizes. Inner surface 106 can consequently be sized to receive barrels of diverse sizes. An exemplary range of firearm barrel diameters that may be received within inner surface 106 can be from about 0.50 inches to about 1.50 inches. The longitudinal axis of barrel engaging portion 102 may be substantially parallel to the longitudinal axis of the firearm barrel. A gap 108 may be defined in the upper end of barrel engaging portion 102. At least two Teflon strips 109 may be disposed on inner surface 106 in opposing pairs. The bottom of barrel-engaging portion 102 can further include a threaded aperture 107 for receiving a threaded fastener.

A pair of arms 110 may extend upwardly from barrel engaging portion 102. Arms 110 may diverge from each other while extending upwardly and away from the barrel engaging portion. Each of arms 110 may have an outer surface 112 and an inner surface 114, as well as a leading edge 116, an upper edge 118 and a trailing edge 120. Arms 110 may be joined to barrel-engaging portion 102 on opposing sides of gap 108.

In some exemplary embodiments, arms 110 may be joined to barrel engaging portion 102 directly, and may be formed integrally therewith. In other exemplary embodiments, as shown in FIG. 1, arms 110 may be joined to barrel engaging portion 102 via connection pieces 119. Connection pieces 119 may be elastic and may allow arms 110 to move independently of barrel engaging portion 102 substantially around an axis parallel to the longitudinal axis of barrel engaging portion 102 with a 1° to 90° arc range of motion, for example with a 60° range. Connection pieces may be constructed of a spring, spring steel, or any other material, as desired.

A plurality of protrusions 122 may be disposed on inner surface 114 and/or the outer surface 112 of each arm 110. In some exemplary embodiments, protrusions 122 may be disposed substantially proximate leading edge 116 and upper edge 118 and may protrude beyond edges 116, 118. Each of the plurality of protrusions 122 can have additional points 124 on the surface thereof. Protrusions 122 can extend substantially vertically from arm 110, and can extend substantially above leading edge 116 or upper edge 118. In some exemplary embodiments, each arm 110 can have at least three protrusions 122, with each protrusions 122 having between two and four additional points 124.

The upper edge 118 of each arm 110 can slope downwardly as it extends rearwardly along the longitudinal axis of leaner 100. Upper edge 118 can terminate in a point 126. The trailing edge 120 of each arm 110 may be substantially L-shaped, curving forwardly and downwardly from point 126, until a vertex 128 and then extending substantially downwardly towards barrel engaging portion 102. Trailing edge 120, or a portion thereof, as well as leading edge 116, or a portion thereof, can be substantially serrated or can include a plurality of undulations 130. A general shape for each arm 110 may further include a substantially arc-shaped surface between leading edge 116 and trailing edge 120.

An extension 132 can extend rearwardly and downwardly from barrel engaging portion 102. Extension 132 can be joined to barrel engaging portion 102 substantially below the inner surface 106 of the barrel engaging portion, or substantially proximate the outer surface 104 of the barrel engaging portion.

Firearm leaner 100 can have a length in the range of about 0.3 inches to 5.0 inches, for example 2.35 inches, a width in the range of about 0.3 inches to 5.0 inches, for example 1.90 inches, and a height in the range of about 0.5 inches to 5.0 inches, for example 2.02 inches. When firearm leaner 100 is coupled to a gun barrel, the maximum span between the barrel and extension 132 can be in the range of about 0.06 to 1.0 inches, for example 0.22 inches.

Referring now to FIGS. 5*a*-5*e*, in operation, the user may install firearm leaner 100 onto the barrel 10 of a firearm by sliding the leaner over the distal end of the barrel. The leaner can be positioned substantially proximate the front sight 12 of the firearm, such that front sight 12 is disposed substantially within gap 108 of leaner 100. The user can then insert a threaded fastener, for example a Teflon thumb screw into aperture 107 so as to fix the barrel between the screw and the upper portion of inner surface 106, thereby reducing the likelihood of leaner 100 rotating or sliding with respect to barrel 10.

Figure 5A:
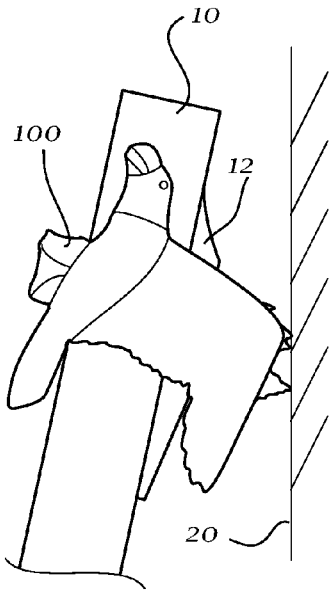
FIGS. 5*a*-5*f* show an exemplary embodiment of a firearm leaner in use.

When the user desires to lean the firearm against an object 20, as shown in FIG. 5*a*, leaner 100 can facilitate supporting the firearm by providing a plurality of contact points between the object protrusions 122 and points 124 disposed on the firearm leaner. Protrusions 122 and points 124 can facilitate leaning the firearm against an object having a substantially vertical surface. Depending on the slope of the surface, as well as the desired lean angle of the firearm, protrusions 112 and points 124 can provide at least two points of contact between leaner 100 and surface 20. In some exemplary embodiments, protrusions 112 and points 124 can provide approximately 8-12 points of contact between leaner 100 and surface 20. Additionally, the plurality of protrusions 122 and points 124 can facilitate securely gripping an object, for example an object having an irregular surface, such as a tree.

Figure 5B:
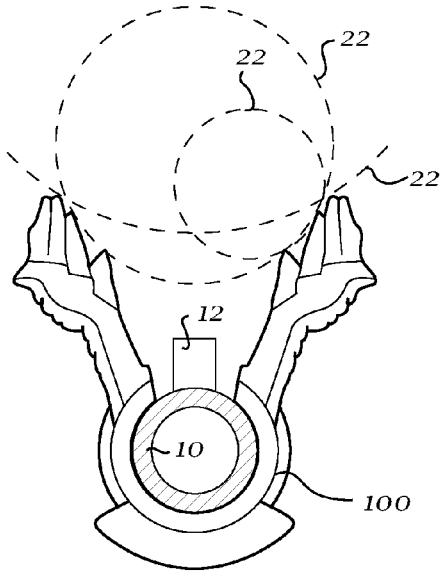

Additionally, the diverging configuration of arms 110 can facilitate leaning the firearm against a substantially tubular or otherwise narrow object 22 that is oriented substantially vertically, such as a tree, a sapling, or a post. Depending on the width of the narrow object, the object 22 may be engaged by protrusions 122 and points 124 on the inner surfaces 114 or outer surfaces 112 of arms 110. Narrower objects 22 can be engaged by arms 110 substantially closer to the barrel of the firearm than objects having greater diameters, thereby creating a straddling effect, as shown in FIG. 5*b*.

Figure 5C:
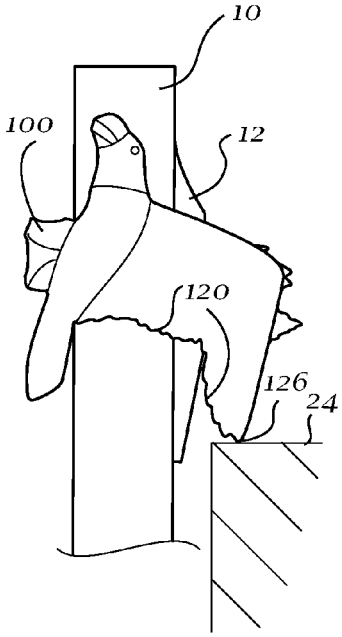
Figure 5D:
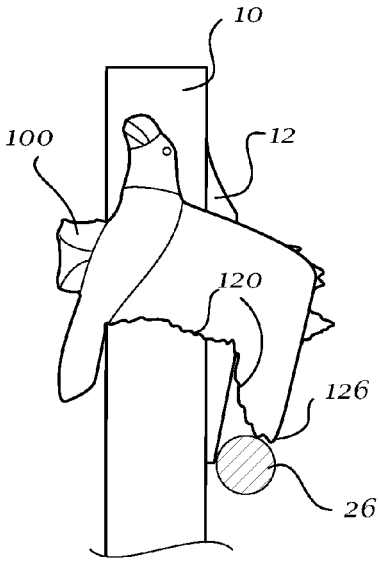

When it is desirable to hang the firearm from an object having a substantially horizontal surface 24, the user may hang the firearm by tightening the thumb screw sufficiently to support the weight of the firearm, and then engaging portions of the trailing edges 120 and/or points 126 of arms 110 to the substantially horizontal surface 24, as shown in FIG. 5*c* For example, the horizontal surface may be engaged by points 126 of arms 110. Additionally, the configuration of the trailing edges 120 can facilitate hanging the firearm from a substantially tubular or otherwise narrow object 26 that is oriented substantially horizontally, such as a ledge, branch, or wire, as well as objects of various diameters and having irregular surfaces. The narrow horizontal object 26 can be engaged by trailing edge 120 such that the object is disposed between arms 110 and the barrel of the firearm, as shown in FIG. 5*d*. In some embodiments, the serrations or undulations 130 on the trailing edge can facilitate securely gripping an object, for example an object having an irregular surface. When leaner 100 is coupled to the barrel of a firearm, points 126 and trailing edges 120 may be disposed substantially over the center of gravity of the firearm, thereby allowing the firearm to hang substantially vertically.

Figure 5E:
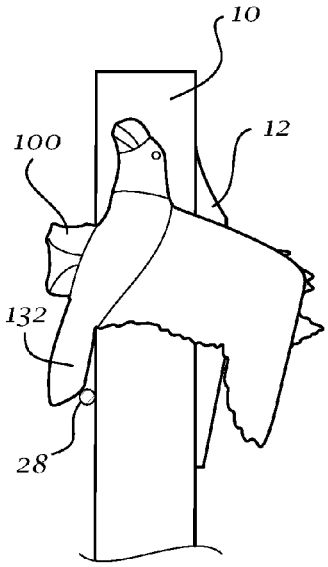

Similarly, an object having a very small diameter 28, for example barbed wire, can be disposed or wedged between extension 132 and the barrel of the firearm, allowing the firearm to be hung from such an object, as shown in FIG. 5*e*.

The divergent configuration of arms 110 can further aid the user in aiming the firearm at a target. When leaner 100 is coupled to barrel 10 of a firearm, front sight 12 can be disposed substantially between arms 110. Consequently, from the point of view of the user, arms 110 can provide a range of aiming therebetween, as opposed to a single specific point of aiming provided by sight 12 by itself. Having a range of aiming defined between arms 110 can aid in target acquisition, for example of moving targets, and allows the user to better focus on the target and on other aspects of the shot and the shooting zone. Furthermore, if a firearm includes a fiber optic sight or other fragile component, the user can position leaner 100 such that the component is disposed between arms 110, thereby facilitating protection the fragile component.

The protrusions 122 and points 124 can further facilitate marking objects. For example, the user can utilize protrusions 122 and points 124 to mark trees or other surfaces to indicate information about the particular location. When leaner 100 is attached to a firearm barrel, the length of the firearm barrel can give the user the ability to make the markings at heights that would otherwise be difficult to reach.

Figure 5F:
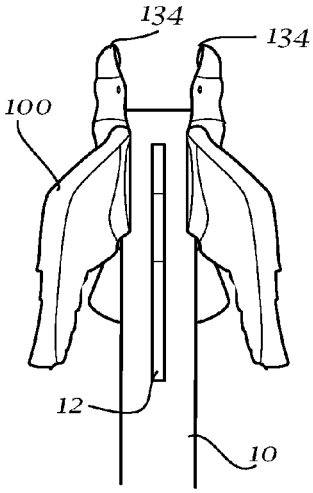

Additionally, leaner 100 may also be utilized as a "prodder" to verify that the downed game has fully expired. As shown in FIG. 5*f*, the user can slide leaner 100 forward on barrel 10 such that the leading tips 134 of leaner 100 protrudes beyond the distal end of barrel 10. The user can then tighten the thumb screw such that leaner 100 is securely coupled to barrel 10. In this configuration, the user may utilize leading tip 134 to prod downed game. Since the area of tips 134 is substantially smaller than that of the distal end of the gun barrel, the contact with the downed game can be minimized.

Figure 6A:
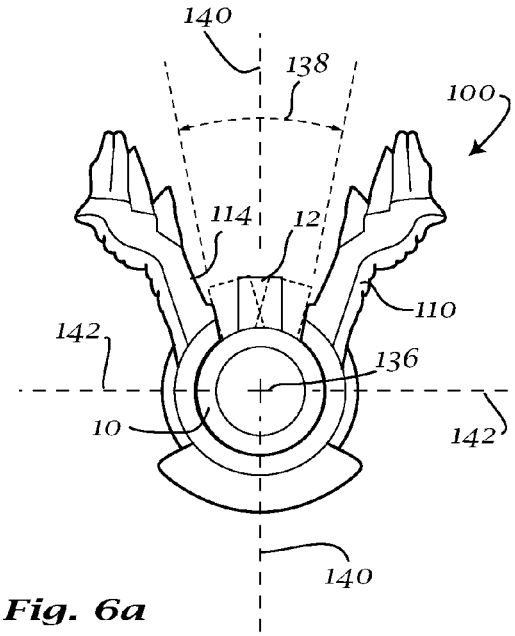
FIGS. 6*a*-6*d* illustrate exemplary pivoting abilities of an exemplary embodiment of a firearm leaner.
Figure 6B:
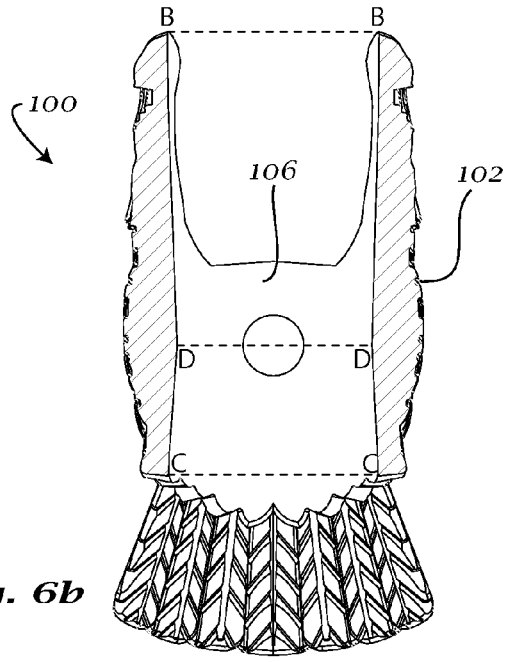
Figure 6C:
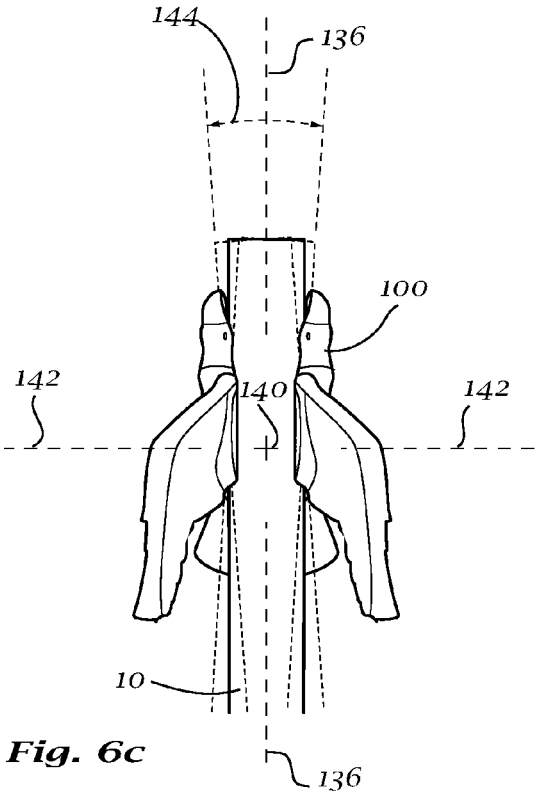

Turning to FIGS. 6*a*-6*c*, in some exemplary embodiments, leaner 100 can provide for a degree of rotation and/or pivoting of barrel 10 in relation to leaner 100. For example, as shown in FIG. 6*a*, leaner 100 can rotate about an axis 136, which may be substantially collinear with the longitudinal axis of firearm barrel 10. The rotational range 138 can be limited by sight 12 coming into contact with a portion of the inner surfaces 114 of arms 110, if the leaner is positioned such that the sight 12 is disposed between arms 110. In some exemplary embodiments, rotational range 138 can be from about 3° degrees to about 90°, for example 15°, although other rotational ranges may be contemplated and provided as desired.

Figure 6D:
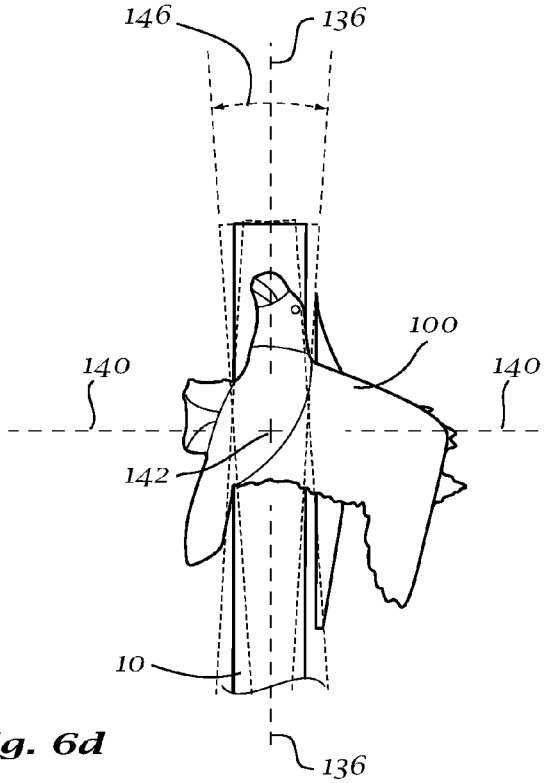

In some exemplary embodiments, the inner surface 106 of barrel-engaging portion 102 may have a substantially bifrustoconical shape, rather than a tubular shape. That is, as shown in FIG. 6*b*, the diameter at location D-D may be less than the diameter at location B-B and C-C. Consequently, as shown in FIGS. 6*c*-6*d*, when a barrel 10 is disposed within barrel-engaging portion 102, the barrel can pivot about an a pair of axes 140, 142, which can be substantially orthogonal to axis 136 and to each other. The ranges of movement 144, 146, can be between about 1° and about 45°, for example 3°, although other ranges of movement may be contemplated and provided as desired. This can therefore define an orbital range for barrel 10, the range being between about 1° and about 45°, for example 3°. When the barrel is coupled to leaner 100, the above-described pivoting of the barrel can facilitate adjusting the center of gravity of the firearm and leaner 100, thereby increasing the likelihood of stable leaning, hanging, and multiple points of contact of the firearm and leaner 100.

Furthermore, while the embodiment illustrated in the Figures includes an ornamental shape which includes the various above-described features of firearm leaner 100, it should be appreciated that a firearm leaner having no ornamental shape or surface treatment and incorporating the various above described features may be contemplated and provided. Furthermore, while the illustrated embodiment has the ornamental shape of an eagle, any ornamental shape may also be contemplated and provided as desired.

The foregoing description and accompanying figures illustrate the principles, preferred embodiments and modes of operation of the invention. However, the invention should not be construed as being limited to the particular embodiments discussed above. Additional variations of the embodiments discussed above will be appreciated by those skilled in the art.

Therefore, the above-described embodiments should be regarded as illustrative rather than restrictive. Accordingly, it should be appreciated that variations to those embodiments can be made by those skilled in the art without departing from the scope of the invention as defined by the following claims.

What is claimed is:

1. A firearm leaner suitable for attachment to the end of a barrel of a firearm, comprising:

a barrel engaging portion;

at least two arms extending upwardly from said barrel engaging portion; and a plurality of points on at least one of the at least two arms, said points extending substantially upwardly from said arms and adapted to engage a surface to support the weight of the firearm.

2. The firearm leaner of claim 1 wherein the number of arms is two.

3. The firearm leaner of claim 1, further comprising at least one extension portion, said extension portion extending rearwardly from at least one of the at least two arms and adapted to engage an object.

4. The firearm leaner of claim 1, further comprising at least one extension portion, said extension portion extending rearwardly from the barrel engaging portion and adapted to engage an object.

5. The firearm leaner of claim 1 wherein the barrel engaging portion includes a threaded aperture for receiving a threaded fastener.

6. The firearm leaner of claim 1 wherein at least one edge of said at least two arms is serrated.

7. The firearm leaner of claim 1 having a length between 0.3 inches to 5.0 inches, a width of 0.3 inches to 5.0 inches, and a height of 0.5 inches to 5.0 inches.

8. The firearm leaner of claim 1 wherein the barrel engaging portion includes an inner surface which is substantially tubular in shape.

9. The firearm leaner of claim 8 wherein the inner surface may receive a firearm barrel between 0.50 inches and 1.50 inches in diameter.

10. The firearm leaner of claim 1, further comprising a connection piece, said connection piece coupling barrel engaging portion to said at least two arms.

11. The firearm leaner of claim 10 wherein said connection piece is made of a flexible material, allowing said at least two arms to move independent of said barrel engaging portion.

12. The firearm leaner of claim 1, further comprising at least one protrusion located on at least one of said at least two arms.

13. The firearm leaner of claim 12 wherein said points are located on said at least one protrusions.

14. The firearm leaner of claim 12 wherein the number of protrusions on each of said at least two arms is three.

* * * * *